US006968602B2

(12) United States Patent
Lee et al.

(10) Patent No.: US 6,968,602 B2
(45) Date of Patent: Nov. 29, 2005

(54) ENHANCED SHOELACES FOR MAINTAINING TENSION WITH NEW PROCESS FOR MANUFACTURING AND PRODUCTS THEREBY

(75) Inventors: James Jong Lee, Anaheim, CA (US); Dong Sick Chang, Busan (KR); Jin Do Kim, Kyung Sang Nam Do (KR)

(73) Assignee: Trion Corporation, Paramount, CA (US)

( * ) Notice: Subject to any disclaimer, the term of this patent is extended or adjusted under 35 U.S.C. 154(b) by 0 days.

(21) Appl. No.: 10/737,039

(22) Filed: Dec. 14, 2003

(65) Prior Publication Data

US 2005/0125971 A1 Jun. 16, 2005

(51) Int. Cl.[7] ..... A43C 9/00; A43C 1/06
(52) U.S. Cl. ..... 24/715.4; 24/712
(58) Field of Search ..... 24/712, 715.4; 36/50.1

(56) References Cited

U.S. PATENT DOCUMENTS 716,877 A * 12/1902 Durand ..... 24/715.4
1,073,496 A * 9/1913 Kempshall ..... 24/715.4
1,282,129 A * 10/1918 Scotson-Clark ..... 24/715.4
1,730,809 A * 10/1929 Dennis ..... 24/715.4
2,477,151 A * 7/1949 Stapleton ..... 24/713
3,059,518 A * 10/1962 Nelson ..... 24/715.4
3,581,353 A * 6/1971 Sonntag ..... 24/715.4
5,638,589 A * 6/1997 Phillips ..... 24/715.4
5,996,256 A * 12/1999 Zebe, Jr. ..... 24/712.5
6,167,599 B1 * 1/2001 Chen ..... 24/715.4

* cited by examiner

*Primary Examiner*—Robert J. Sandy
(74) *Attorney, Agent, or Firm*—Peter Jon Gluck; Greenberg Traurig LLP

(57) ABSTRACT

Enhanced lace tightening system including a plurality of apertures extending through the main body of a shoelace and smoothly finished end caps allowing unimpeded passage therethrough. A process includes a finishing step whereby end caps are generated without frayed edges to facilitate passage of the same through apertures to position appropriate aspects of the laces rapidly in a position from whence little tension loss occurs when properly disposed. Products by the process incorporate silicone, metallic elements, and related enhancements providing specifically improved shoelaces for any number of applications for a stated goal of drawing and fixing together two opposite edges.

1 Claim, 3 Drawing Sheets

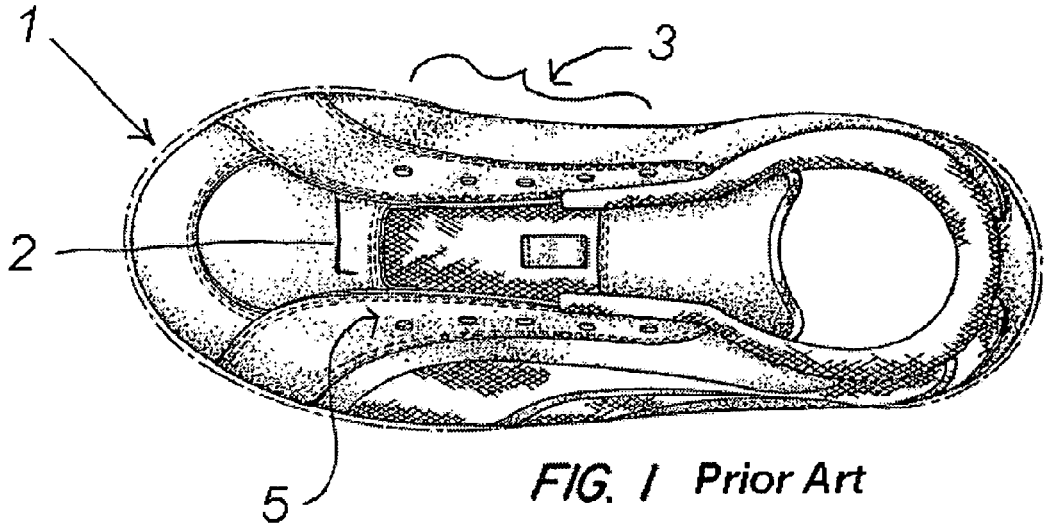
FIG. 1 Prior Art
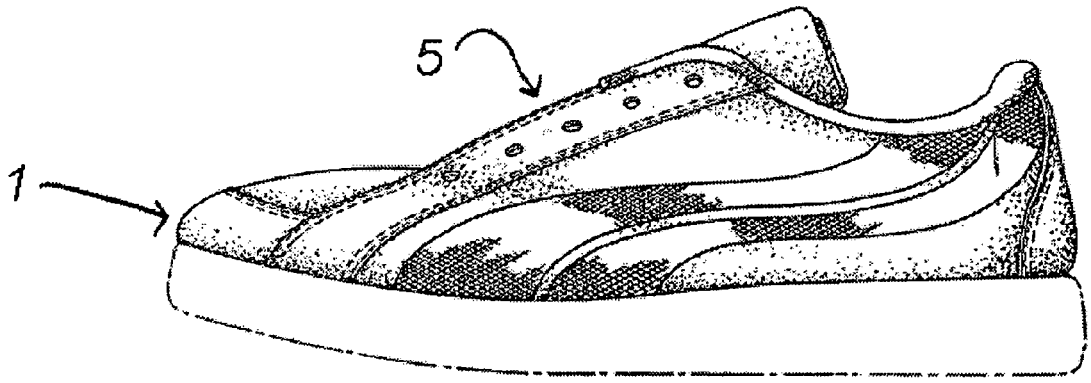
Prior Art FIG. 2
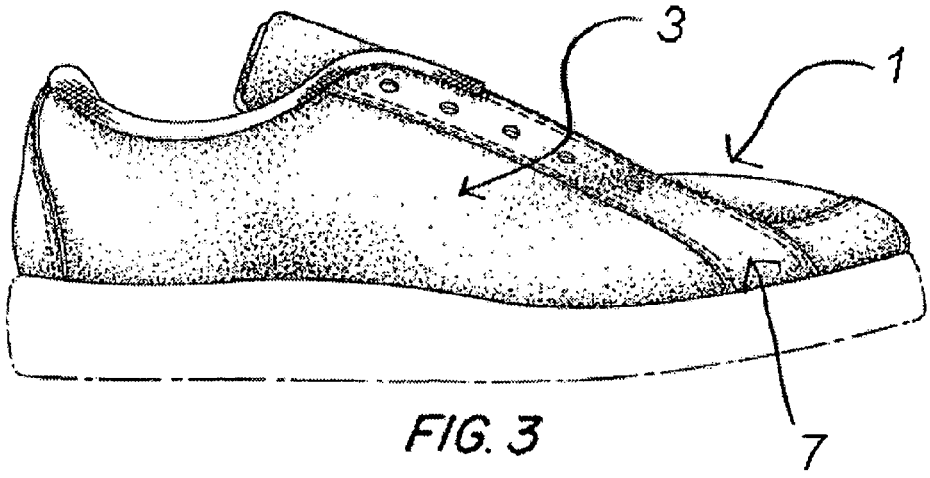
FIG. 3
Prior Art

ENHANCED SHOELACES FOR MAINTAINING TENSION WITH NEW PROCESS FOR MANUFACTURING AND PRODUCTS THEREBY

FIELD OF THE INVENTION

The present invention relates to cords, ribbons or strings used to draw and tie together two opposite edges, in a modern sense mostly used to used to adorn and secure various items. In particular, the present invention relates to shoelaces, particularly those used with shoes designed for athletics and the skateboarding arts.

BACKGROUND OF THE INVENTION

Shoelaces are commonly used to replace other rigid or quasi-rigid means for keeping feet inside of shoes. Likewise, given the shoes that large specialized groups of athletes, children and skateboarders use today, which are to a certain extent 'elastically deformable', often a need arises for lacing structures and systems which either appear to maintain tension, or are not easily "untied" depending on the specific case.

Known among those skilled are different varietes of materials and mechanisms for these and related purposes. However, to date no system has been perfected allowing a user to have laces disposed, for example, on the front of shoes without losing tension without deleterious aesthetics—or simple failures of function or design.

In light of the above, there remains a need for a novel enhanced lacing system which corrects for a variety of existing shortcomings and is less sensitive to decentration, torque, tilt and the other things that generally make laces loose tension, while being pleasing to the eye.

BRIEF DESCRIPTION OF THE DRAWINGS

FIG. 1 is a top plan view of a conventional skateboarding type of shoe showing holes through which laces may be arrayed to achieve appropriate tensioning;

FIG. 2 is an outside view of a conventional skateboarding type of shoe showing holes through which laces may be arrayed to achieve appropriate tensioning;

FIG. 3 is an inside view of a conventional skateboarding type of shoe showing holes through which laces may be arrayed to achieve appropriate tensioning;

DESCRIPTION OF THE PREFERRED EMBODIMENTS

Figure 4:
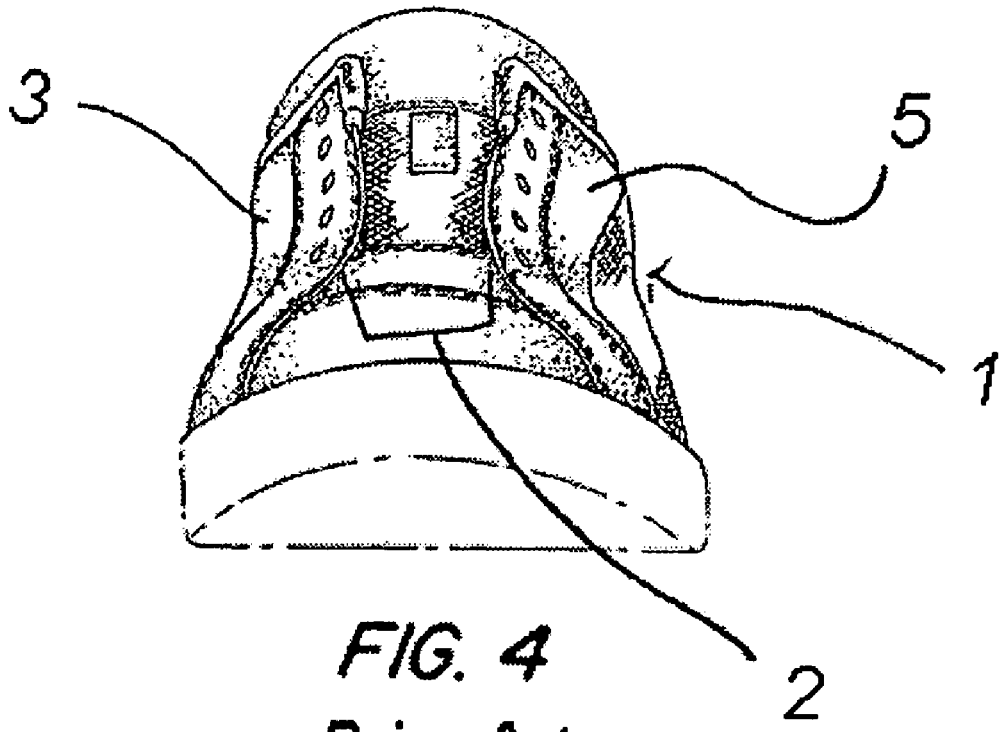
FIG. 4 Prior Art
FIG. 4 is a frontal view of a conventional skateboarding type of shoe showing holes through which laces may be arrayed to achieve appropriate tensioning.

FIG. 1 is a top plan view of a conventional skateboarding shoe 1 showing a plurality of through-holes on an inside portion 3, and a plurality of through-holes on outside portion 5. Prior art lacing schemes have relied upon adjusting relative tensions between a first set of through holes on inside edge 3, and second set on outside portion 5, to maintain shoe 1 in the desired relationship to a user's foot. This is done by decreasing the space 2, by shortening the length of lace (not shown) between respective through-holes on inside portion 3 and outside portion 5.

Turning to FIG. 2, shoe 1, with plurality of through-holes on outside portion 5, serves to draw and fix together two opposite edges 3 (not shown) and 5 of shoe 1. This is generally done by using a pair of through-hole of each one of opposite edge 3 (not shown) and 5 which are tensioned by shortening the relative distance 2 between them (see FIG. 1 and FIG. 4).

However, there are shoes and desired configurations whereby a user does not necessarily desire to impact the relative distance 2(see FIG. 1 and FIG. 4) between opposite edges 3 and (not shown) 5 of the shoe 1.

FIG. 3, for example, shows gusset 7 of edge 3 which may be stiffened, re-inforced, or otherwise made resistant to flexible change or deformation. In such a case, over-tensioning laces between edge 3, and outside edge 5 can change the shape of shoe 1 in a way that is not desired. Likewise, other characteristics of shoe 1, may create a need to maintain relative distance 2(see FIG. 1 and FIG. 4) at a fixed dimension.

FIG. 4 presents such a case, where a user may wish to maintain relative distance 2 in a fixed relationship to the other component parts of the shoe. Prior to the advent of the present invention, edges 3 and 5 could not been maintained in a fixed positional relationship to the remainder of shoe 1, without tensioning issues.

Figure 5:
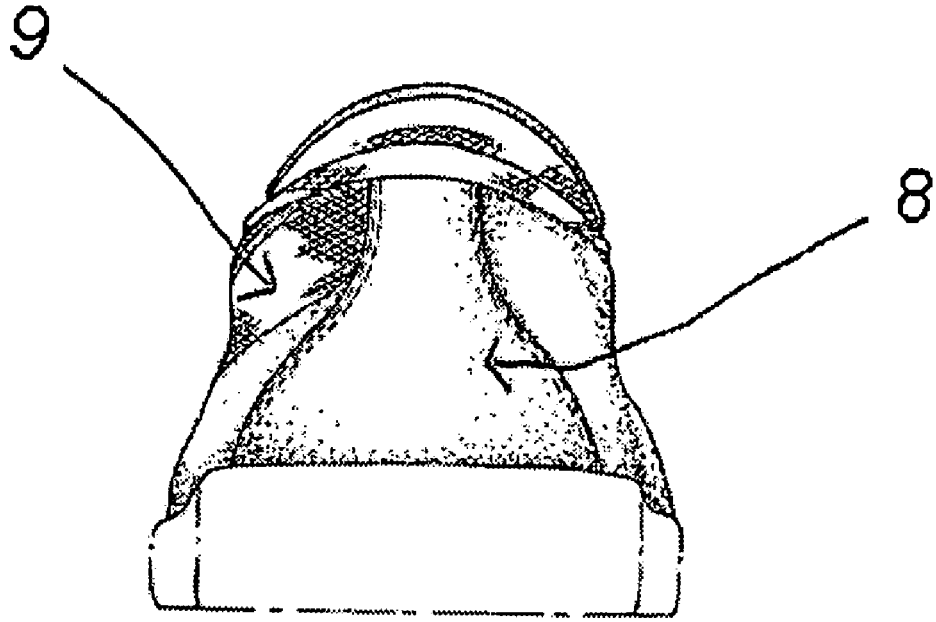
FIG. 5 Prior Art
FIG. 5 is a back view of a conventional skateboarding type of shoe showing holes through which laces may be arrayed to achieve appropriate tensioning.

FIG. 5 also presents a situation whereby stiffened back portion 8, would cause logo 9 to be stretched in an unfavorable way with current lacing systems.

Figure 6:
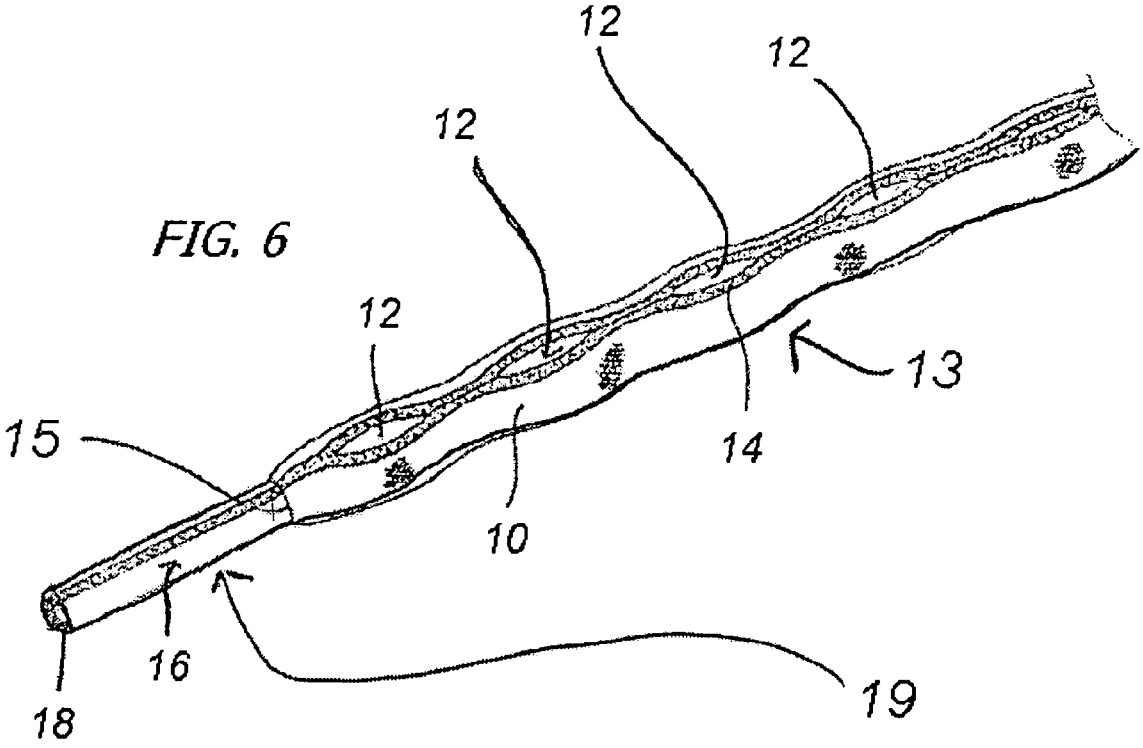
FIG. 6 is a plan view of a shoelace according to the present invention for use with prior art shoes (or other items) and conventional skateboarding types of shoes having holes through which laces may be arrayed to achieve appropriate tensioning.

FIG. 6 shows an embodiment of the present invention having any number of apertures 12 disposed within body of lace 10 such that end cap 16 can easily pass through aperture 12, within becoming inconveniently lodged therein. Reinforcement 14 may optionally be aligned along the top or bottom or both edges of lace 10 peripheral to each aperture 12.

Lace 10 diverges from known shoelaces in that each outer side surface 13 bulges slightly outward proximate to each aperture 12 and pinches inward in the space directly adjacent to each aperture 12. End cap 16, with outer portion 18 re-inforced and smoothed to enable ready passage of end cap 16 and outer portion 18 through any one of apertures 12, without becoming enmeshed in the same.

Figure 7:
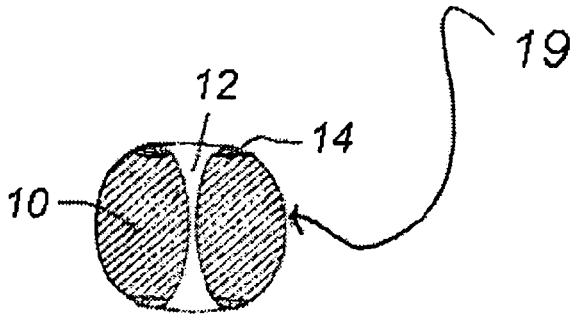
FIG. 7 is a cross-sectional view of a shoelace, such as that shown in FIG. 6, according to the present invention.

FIG. 7 show a cross-sectional view of lace body 10, showing aperture 12 positioned such that end cap 16 with outer portion 18 may pass therethrough without frictional engagement until distal border 15 is reached. By having specially treated and process end cap 16 outer portion 18, the method of tightening of the present invention is achieved. Namely, smooth passage through lace body 10 at aperture 12 can be achieved for tensioning purposes until an area of lace 10 downstream of distal border 15 is at a position to engage the inside portion of aperture 12. By allowing rapid and smooth passage of end cap 16 through aperture 12 a desired tension level can be set, which then permits maintenance of said tension level by the fabric to fabric friction which is maintained.

Figure 8:
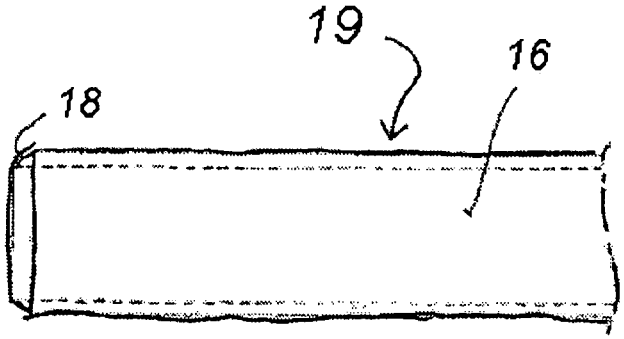
FIG. 8 is a cross-sectional view of a shoelace, such as that shown in FIG. 6, according to the present invention, with a detailed view of either end-cap showing the smoothly finished treatment allowing unimpeded passage through aperture means.

FIG. 8 likewise shows end cap 16 with outer portion 18 that has been processed such that no frayed or loosened fabric or plastic pieces exist. Accordingly it is an aspect of the present invention to teach a process whereby a lacing member is created comprising the step of process finishing the end cap 16, by at least one of chemical, mechanical, thermal and a combination of these types of treatments whereby outer portion 18 does not present roughened elements along the entiety of its peripheral surface 19.

Peripheral surface 19 of end cap 16, likewise including outer portion 18 passes readily through aperture 12 of smooth passage through lace body 10. By passing peripheral surface 19 of end cap 16 leading with outer portion 18, effective passage through aperture 12 can be achieved for tensioning purposes until an area of lace 10 downstream of distal border 15 is at a position to engage the inside portion of aperture 12. By allowing rapid and smooth passage of end cap 16 through aperture 12 a desired tension level can be set, which then permits maintenance of said tension level by the fabric to fabric friction which is maintained respectively between inside and outside faces of lace body 19.

There has been no teaching among the existing arts whereby apertures 12 can both permit ready passage and selective tensioning of aspects of lace body 10, in compliance with a user's wishes. According to the present invention there is disclosed an improvement in the science of lace-making whereby enhanced utility and user friendlyness is achieved by smoothly finishing peripheral surface 19 by known chemical processing means such that outer portion 18 of end cap 16 does not become lodged inadvertendly in aperature 12.

Referring now to reinforcement strip 14, silicone or any materials having appropriate properties within the normal skill level of artisans line aspects of lace body 10, either at an edge of any respective aperture 12, or any other location along lace body 10. Often reinforcement strip 14 is a material such as a silicone, cast in a color, topical surface feature, or other gross geometrical fashion differentiating the same from lace body 10.

A process for creating silicone reinforced lacing members with holes extending through the members and chemically treated end caps allowing for ready passage is taught. New fashion shoelaces styled EYELETE MAGIC LACES (MSL-173) and MAGIC LACES (MSL-501/MSL-502) are available from Trion Corporation (16100 Gundry Avenue, Paramount Calif. 90723) which products embody this process.

Essentially, the instant teachings can be used for any known systems used to draw and tie together two opposite edges, in a modern sense mostly used to used to adorn and secure various items. For example, skateboard shoe laces can be threaded through conventional eyelets and placed in a position whereby with or without securement by traditional knotting schemes.

Further uses of the benefits of the instant teahcings will become known to those skilled in the art by studying the figures in combination with the claims which are appended hereto.

While this invention has been described with respect to various specific examples and embodiments, it is to be understood that the invention is not limited thereto and that it can be variously practiced within the scope of the following claims.

What is claimed is:

1. A shoe lace for drawing and fixing together two different edges, comprising: a lace body having a longitudinal length and at least two opposing sides; the lace body further including a plurality of discrete apertures disposed therethrough and along the longitudinal length, and an end cap device having a smooth outer finish, which the end cap passes readily through each of said plurality of discrete apertures without becoming frictionally engaged within any of said plurality of discrete apertures, thereby permitting said lace body to engage said discrete apertures for drawing and fixing together the two different edges.

* * * * *